United States Patent [19]

Gannon

[11] 3,991,851

[45] Nov. 16, 1976

[54] SAFETY LADDER FOR ABOVE-THE-GROUND SWIMMING POOLS

[75] Inventor: Peter F. Gannon, Troy, Mich.

[73] Assignee: Vinyl-Fab Industries, Ferndale, Mich.

[22] Filed: Apr. 16, 1975

[21] Appl. No.: 568,586

Related U.S. Application Data

[62] Division of Ser. No. 388,393, Aug. 15, 1973, Pat. No. 3,908,795.

[52] U.S. Cl. ..... 182/86; 182/106; 182/228

[51] Int. Cl.[2] ..... E06C 9/08

[58] Field of Search ..... 182/83, 86, 97, 118, 182/119, 106, 228

[56] References Cited

UNITED STATES PATENTS

| | | | |
|---|---|---|---|
| 3,390,740 | 7/1968 | Brandel | 182/118 |
| 3,586,124 | 6/1971 | Kunzweiler | 182/97 |
| 3,908,795 | 9/1975 | Gannon | 182/93 |

*Primary Examiner*—Reinaldo P. Machado
*Attorney, Agent, or Firm*—Hauke & Patalidis

[57] ABSTRACT

A safety ladder for an above-the-ground swimming pool in which a pivotal ladder section is both detachable and capable of being swung up off the ground in order to prevent unauthorized access to the pool by small children, animals, and the like.

3 Claims, 8 Drawing Figures

SAFETY LADDER FOR ABOVE-THE-GROUND SWIMMING POOLS

This is a division of application Ser. No. 388,393, filed Aug. 15, 1973, now U.S. Pat. No. 3,908,795.

BACKGROUND OF THE INVENTION

I. Field of the Invention

The present invention relates to safety ladders for above-the-ground swimming pools and more particularly to a safety ladder having a pivotal ladder section which is both detachable and capable of being swung up off the ground in order to prevent unauthorized access to the pool.

II. Description of the Prior Art

Many safety ladders for above-the-ground swimming pools have been disclosed in the prior art, such as in U.S. Letters Pat. No. 3,586,124, which provides a pivotal ladder section that may be swung up off the ground to prevent unauthorized access by small children. Such an arrangement has been found to be satisfactory when the pool is left unattended by an adult for a short period of time. However, it has been found that when the pool is left unattended for longer periods of time, such as, for example, when the family is away on vacation, naturally mischievous children desiring to use the pool have discovered innumerable alternate methods for reaching the up-swung ladder section and swinging the ladder section to its downward and accessible position. With the pivotal ladder section in its downward and accessible position, the swimming pool is easily accessible to all children in the area without adult supervision which encourages unauthorized use of the swimming pool and, all too often, results in tragic and sometimes fatal accidents.

SUMMARY OF THE INVENTION

The safety ladder of the present invention generally comprises a pivotal ladder section intermediate a platform disposed above the retaining wall of an above-the-ground swimming pool and the ground area immediately surrounding the pool. The ladder section may either be swung into an upper position whereby the ladder is out of the reach of small children, animals, and the like or swung into a down, or in use, position. The ladder section is also easily detached from the safety ladder structure of the present invention by removing a spring bracket assembly thus permitting the entire ladder section to be stored in a place distant from the swimming pool.

It is thus apparent that the safety ladder structure of the present invention quickly, easily, and inexpensively overcomes the abovementioned disadvantages of the prior art.

It is therefore a primary object of the present invention to provide a safety ladder for an above-the-ground swimming pool having a pivotal ladder section that may be conveniently and easily swung up off the ground out of the reach of small children when the pool is left unattended for comparatively short periods of time, and may also be easily detached without the use of tools and stored in a place distant from the swimming pool when the pool is left unattended for comparatively long periods of time.

Other objects and advantages of the present invention will become apparent to those skilled in the art when the following detailed description of the present invention is read in conjunction with the accompanying drawing where like reference characters refer to like parts throughout the several views and in which:

DESCRIPTION OF THE PREFERRED EMBODIMENTS

Figure 1:
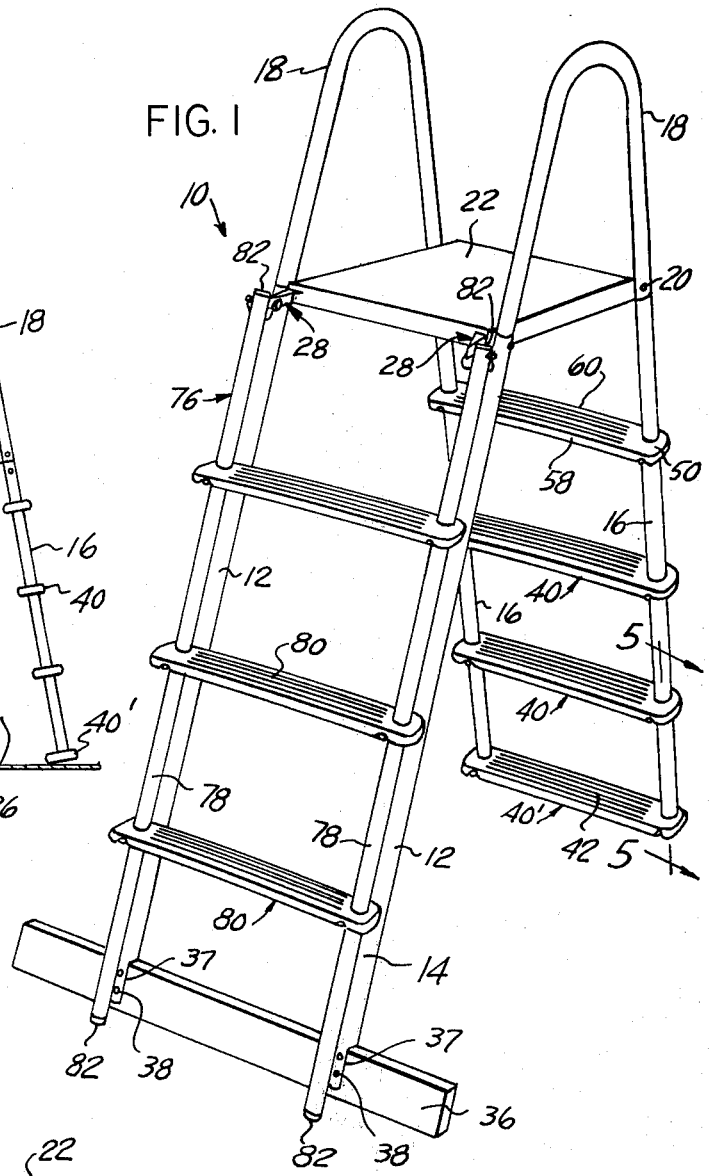
FIG. 1 is an elevated perspective view of an embodiment of the safety ladder of the present invention.
Figure 2:
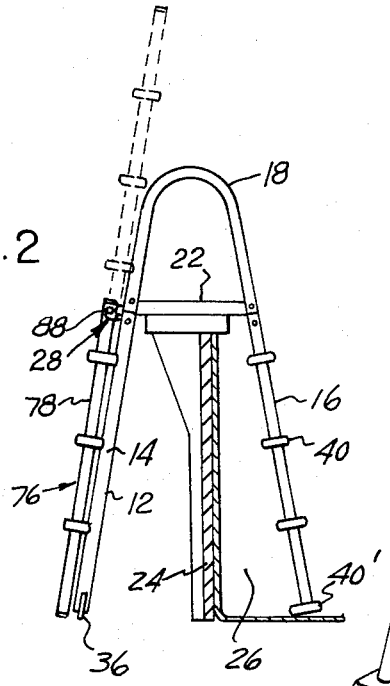
FIG. 2 is a side elevational view of the safety ladder structure of FIG. 1, installed over an above-the-ground swimming pool.

Referring now to FIGS. 1 and 2, the safety ladder 10 of the present invention generally comprises a pair of substantially parallel and identical side rails 12 in the shape of an inverted V or U. The side rails 12 are preferably made from a rust resistant material, such as anodized aluminum, and are preferably of lightweight and inexpensive tubular construction. Furthermore, the side rails 12 may be of single piece construction or may be of three piece construction comprising two substantially straight sections or members 14 and 16 and a middle inverted V or U-shaped portion 18 fastened together by bolts 20 although screws, or any conventional fastening means may be used.

A generally rectangular platform 22 is disposed intermediate of the side rails 12 in a generally horizontal plane at an elevation slightly more than the height of a wall 24 (FIG. 2) of an above-the-ground swimming pool 26. The platform 22 is secured to both of the side rails 12 by bolts 20, or by any conventional means such as screws, welding, and the like, and may also be secured by conventional means (not shown) to the top of the wall 24 of the pool 26. The platform 22 serves as a landing platform for swimmers exiting from or entering the pool and, as such, is preferably provided with a textured or otherwise rough upper surface to prevent swimmers from slipping from the platform 22 and possibly injuring themselves. Similarly, the platform 22 may be either of solid or formed construction but should be of sufficient strength to support the weight of an above-average weight adult. A pair of spaced brackets 28 (best seen in FIG. 3), having associated side portions 30 and top support portions 32, extend laterally outward from the base of the platform 22 substantially between the portions 14 of the side rails 12 on one end of the platform 22 between the side rails 12. A round aperture 34 is provided through each of the side portions 30 of the brackets 28 for a purpose to be later herein described.

It will be apparent that the frame of the safety ladder 10 thus far described is a self-supporting structure. However, in order to increase the stability of the safety ladder 10, the free end of each side rail portion 14 is provided with a transverse slot 37 therethrough which receives the upper edge of a laterally extending base board 36. Preferably a plurality of bolts 38, or the like extend laterally through the ends of the side rail portions 14 and the base board 36, substantially perpendicular to the longitudinal axis of the slot 37, to secure the base board 36 to the side rail portions 14. The base board 36 also serves the additional function of preventing the side rail portions 14 from digging into the ground in the area surrounding the pool and of maintaining the safety ladder 10 substantially level with the ground.

Figure 5:
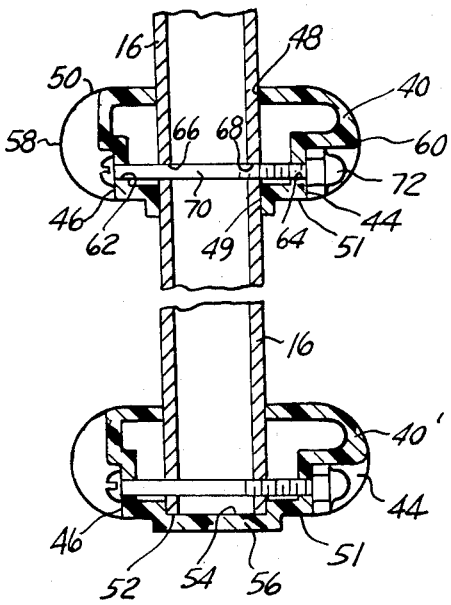
FIG. 5 is a fragmentary cross-sectional view taken substantially along line 5—5 of FIG. 1.

A number of steps 40, best seen in FIGS. 1 and 5, are secured substantially horizontally between the side rail members 16 which extend into the pool 26. The steps 40 are preferably hollow injection molded plastic and serrated on their upper surface, as shown at 42, to provide a rough, textured surface and prevent swimmers from slipping off the steps 40. The steps 40 are also preferably bowed slightly upward to enhance the strength of the steps. Since the means for attaching the steps 40 to the side rail members 16 is identical for each side rail member 16, the attachment means will only be described for one of the side rail members 16.

A pair of circular apertures 48 and 49. FIG. 5 both slightly larger in diameter than the outside diameter of the side rail member 16, are formed vertically through the end portion 50 of the steps 40 in axial alignment with each other (except for the bottom step 40') and adapted to receive the side rail member 16 therethrough. It is thus apparent that the steps 40 may be easily positioned on the side rail member 16 by sliding steps 40 up along the side rail members 16 to their respective positions with the side rail member 16 extending through apertures 48 and 49. The aperture 49, normally formed through the bottom surface 51 of the steps 40, is omitted from the bottom step 40' which rests on the bottom of the pool 26 so that the free end 52 of the side rail member 16 abuts against the upper surface 54 of the bottom face 56 on the bottom step 40'. The surface 54 thus serves to prevent the end 52 of the side rail member 16 from digging into and puncturing the bottom of the pool 26.

Figure 4:
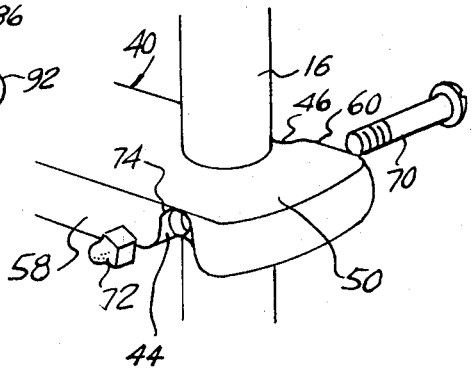
FIG. 4 is an exploded view of a fastening means securing the steps to the frame of the safety ladder structure of the present invention.

Two spaced and laterally opposing recesses 44 and 46 are formed in the sides 58 and 60, respectively, on the end portion 50 of the steps 40 and adjacent to the side rail member 16. The recess 46 is generally in the shape of a half cylinder extending vertically through the step 40 for a purpose to be later herein described. A pair of round apertures 62 and 64, formed or drilled through the recesses 44 and 46, respectively, and in axial alignment with each other, register with the two round apertures 66 and 68 formed by any conventional means such as drilling, through the side rail member 16 so that a bolt or screw 70 may be inserted through all four apertures 62–68 to secure the steps 40 to the side rail member 16. A hexagonal nut 72 in the recess 46 received the screw 70 in the conventional manner. For ease of assembly the recess 44 may have a hexagonal outline 74 (FIG. 4), or a portion thereof, adapted to receive the hexagonal nut 72 and prevent the nut 22 from turning when held by the hexagonal outline 74 so that only a screwdriver is required to attach the steps 40 onto the side rail member 16.

The steps 40 are preferably spaced equidistant from each other along the side rail members 16 and is should be apparent that the number and spacing of apertures 66 and 68 of the side rail members 16 correspond with the number and spacing of the steps 40 along the side rail member 16.

A pivotal ladder section 76 comprises two generally straight and parallel tubular side support members 78 with a number of steps 80 disposed horizontally therebetween. The steps 80 are substantially identical in form and means of attachment to the side and support members 78 to the steps 40 as have been described hereinabove. Preferably plastic caps 82 are inserted into the open ends of the tubular side support members 78 to eliminate sharp edges which might otherwise scrape or cut swimmers.

Figure 3:
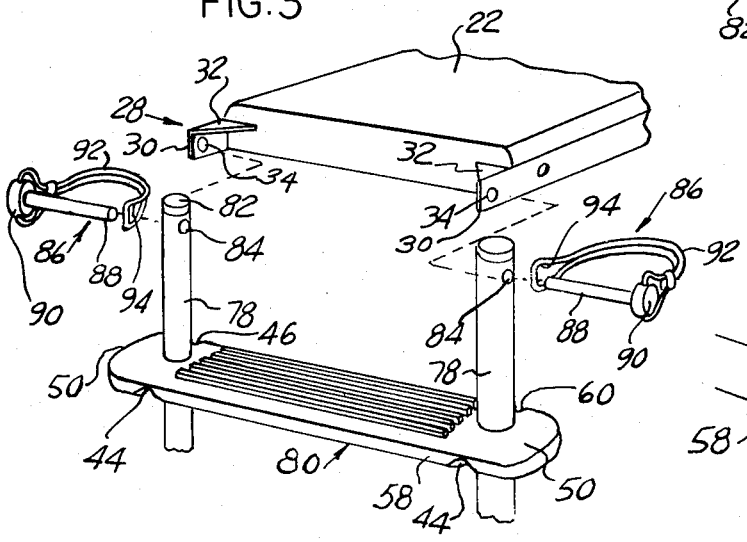
FIG. 3 is an exploded view of the removable pivot means connecting the pivotal and removable ladder section to the frame section of the present invention.

Referring now primarily to FIG. 3, transverse holes 84 are drilled, punched, or otherwise formed laterally through the upper end of the side support members 78 and adapted to register with the apertures 34 in the brackets 28 extending outwardly from the platform 22. The means for attaching the ladder section 76 to the brackets 28 generally comprises a locking pin assembly 86 having a cylindrical pin member 88 with an enlarged head portion 90 at one end thereof. A U-shaped resilient member 92 is pivotally mounted at one end to the enlarged head 90 of the pin 88 and has a loop 94 at its other end. The loop 94 is adapted to receive and lock the pin 88 in place when the resilient member 92 is in its non-deformed state. The resilient member 92, however, may be easily resiliently bent away from the pin 88 to release the end of the pin 88 from the loop 94.

In operation, the safety ladder 10 is placed over the wall 24 of the pool 26 with the side rail members 16 extending into the pool 26. In this position the bottom step 40' on the side rail members 16 rests on the bottom of the pool 26 while the base board 36 rests on the ground immediately surrounding the pool. The ladder section 76 is then placed adjacent the side rail members 14 so that the holes 84 on the support members 78 register with the holes 34 on brackets 28 and the side rail members 14 flushly nest within the recesses 46. The pins 88 are then inserted individually through the apertures 84 and 34 on each support member 78 and bracket 28, and the resilient members 92 are deformed to lock the pins 88 in loops 94. It is obvious that after each pin 88 is properly locked into position the pins 88 serve as pivot points for the ladder section 76 so that the ladder may be swung upward out of the reach of small children as shown by the dotted lines in FIG. 2. The ladder section 76, when in its up-swung position, abuts against the middle inverted-V portion 18 of the side rails 12 so that the center of gravity of the ladder section 76 is disposed above and rightward, as seen at FIG. 2, of the pivot pins 88 thereby permitting the weight of the ladder section 12 to maintain the ladder section 76 in its up-swung position. It should also be understood that the entire ladder section 76 may be removed and stored in a place distant from the pool 26 by simply disengaging the locking pin assembly 86 and carrying the ladder section 76 to its intended storage area.

Figure 6:
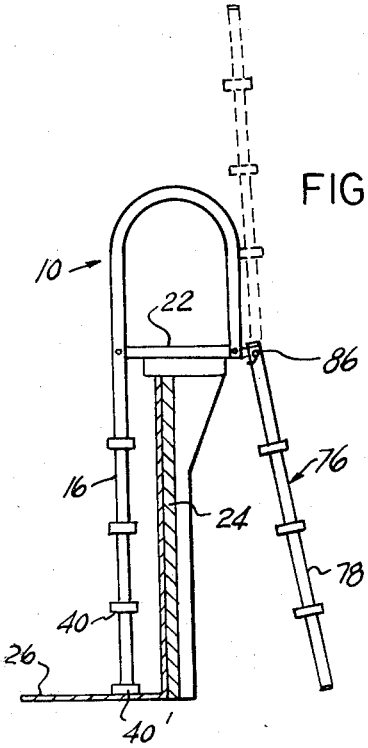
FIG. 6 is a side elevational view of a modification of the safety ladder structure of the present invention.

A modification of the present invention is illustrated in FIG. 6 in which the platform 22 is firmly secured by bolts, screws, or any other conventional means (not shown) to the retaining wall 24 of the swimming pool 26. With platform 22 firmly attached to the retaining wall 24, the side rails extending from the platform 22 to the ground area immediately surrounding the pool 26, as shown in the first embodiment of the invention, may be eliminated, since the support previously provided by the said eliminated side rails is no longer required.

Likewise, it is no longer necessary that the bottom step 40' on side rails 16 contact the bottom surface of the pool 26 since the rigidly attached platform 22 and the pool retaining wall 24 provide the required support for the safety ladder 10. The ladder section 76 and its connecting locking pin 86 remain substantially as hereinbefore described.

Figure 7:
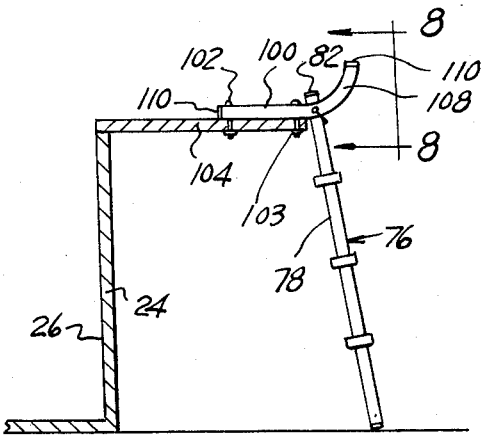
FIG. 7 is a side elevational view of a further modification of the present invention.
Figure 8:
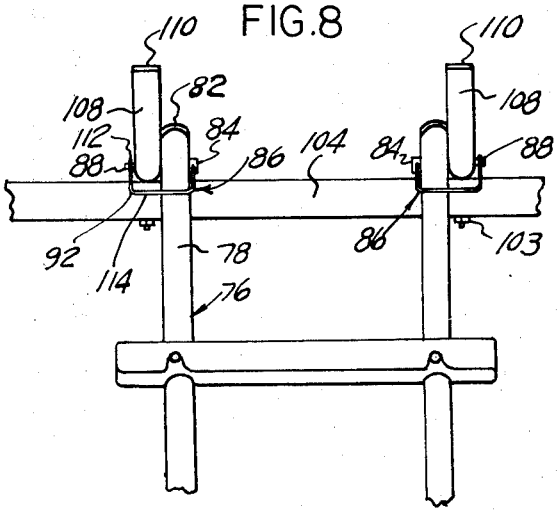
FIG. 8 is a view taken substantially along line 8-8 of FIG. 7.

Many above-the-ground swimming pools are constructed with a wide deck, often made of wood, surrounding a portion of the rim of the pool wall. To adapt the safety ladder of the present invention to above-the-ground swimming pools having this type of a deck, yet another modification of the present invention is illustrated in FIGS. 7 and 8. In FIGS. 7 and 8 two preferably tubular J-shaped support members 100 are firmly fastened by screws 102 and nuts 103, or the like, to a deck 104 so that the tail ends 108 of the J-shaped support members 100 extend somewhat out over the ladder section 76 and point substantially vertically upward. In this position the tail ends 108 of the J-shaped support members 100 serve as posts that a person climbing on the ladder 76 may grasp in order to aid his entry onto or exit from the deck 104. Preferably plastic caps 110 are inserted into the open ends of the J-shaped members 100 to prevent injuries. Since the desk 104 has its own structural support (not shown), the previously described side support rails are no longer necessary. Likewise the previously described platform is no longer necessary since the deck 104 serves as a platform. The locking pin 86 (FIG. 8) is substantially as previously described except that the pivotal pin 88 must be somewhat longer since the pin must be extended both through the side support member 78 with apertures 84 and registering apertures 112 in the J-shaped members 100. The resilient member 92 may also have a flattened portion 114 to more readily accommodate the additional length of pin 88.

It should be apparent that great care has been exercised to eliminate all sharp edges from the ladder assemblies of the present invention whereby swimmers would otherwise cut and injure themselves. It should also be apparent to those skilled in the art of the present invention that many modifications may be made to the above described safety ladder without departing from the spirit of the invention or the scope of the appended claims.

What is claimed is:

1. A safety ladder for a swimming pool having a deck supported at an elevated position above the ground, said safety ladder comprising:

support means elevated above the ground comprising a pair of spaced and substantially parallel J-shaped support members secured to the top surface of said deck at an edge thereof, a pivotal detachable ladder section having two substantially parallel and elongated spaced side support members with a plurality of steps fastened intermediate of said side support members, and connecting means for pivotally and detachably attaching said ladder section to said support means.

2. The invention as defined in claim 1 in which said connecting means comprises:

a pin, and a generally U-shaped resilient member, pivotally mounted on one end of said pin, and having a loop on its other end adapted to engage and lock the free end of said pin.

3. The invention as defined in claim 1, wherein said steps have an aperture on each end for receiving said side support members therethrough and means to secure said steps to said side rail members when said steps are properly positioned.

* * * * *